US011555330B2

(12) United States Patent
Chong et al.

(10) Patent No.: US 11,555,330 B2
(45) Date of Patent: Jan. 17, 2023

(54) PRIVACY LOCK

(71) Applicant: SPECTRUM BRANDS, INC., Middleton, WI (US)

(72) Inventors: Gerald Chong, Irvine, CA (US); Lynthia Li, Xiamen (CN); Thomas P. Morse, Wyomissing, PA (US); Eric Xin, Xiamen (CN); James Lin, Laguna Niguel, CA (US)

(73) Assignee: Spectrum Brands, Inc., Middleton, WI (US)

( * ) Notice: Subject to any disclaimer, the term of this patent is extended or adjusted under 35 U.S.C. 154(b) by 563 days.

(21) Appl. No.: 15/484,739

(22) Filed: Apr. 11, 2017

(65) Prior Publication Data

US 2017/0218659 A1 Aug. 3, 2017

Related U.S. Application Data

(63) Continuation-in-part of application No. 15/333,662, filed on Oct. 25, 2016, now Pat. No. 10,753,121.
(Continued)

(51) Int. Cl.
*E05B 13/00* (2006.01)
*E05C 1/16* (2006.01)
(Continued)

(52) U.S. Cl.
CPC ..... *E05B 13/004* (2013.01); *E05B 3/065* (2013.01); *E05B 63/0069* (2013.01); *E05C 1/163* (2013.01)

(58) Field of Classification Search
CPC ..... Y10T 292/1022; Y10T 292/1016; Y10T 292/1028; Y10T 292/96; Y10T 292/098; Y10T 292/0982; Y10T 292/0983; Y10T 292/0986; Y10T 70/55; Y10T 70/5518; Y10T 70/5394; Y10T 70/5398; Y10T 70/5403; Y10T 70/5407; Y10T 70/5412;
(Continued)

(56) References Cited

U.S. PATENT DOCUMENTS 2,263,477 A * 11/1941 Voight ..... E05C 1/163 292/169.16
2,386,868 A * 10/1945 Karczewski ..... E05C 1/163 292/169.16
(Continued)

FOREIGN PATENT DOCUMENTS

CN 200968091 Y 10/2007
CN 104847181 A 8/2015
(Continued)

OTHER PUBLICATIONS

First Chinese Office Action for Application No. 201680068649.4 dated Aug. 29, 2019.
(Continued)

*Primary Examiner* — Alyson M Merlino
(74) *Attorney, Agent, or Firm* — Merchant & Gould P.C.

(57) ABSTRACT

A privacy lock assembly and method of operation are provided. The lock assembly has a push button offset from the central axis of the lock assembly for locking and unlocking the assembly. The lock assembly includes compression springs to maintain integrated handles in predetermined orientations when the handles are not subject to a load.

19 Claims, 14 Drawing Sheets

Related U.S. Application Data

(60) Provisional application No. 62/250,201, filed on Nov. 3, 2015.

(51) Int. Cl.
*E05B 3/06* (2006.01)
*E05B 63/00* (2006.01)

(58) Field of Classification Search
CPC ..... Y10T 70/542; Y10T 70/5429; Y10T 70/5434; Y10T 70/5438; Y10T 70/5442; Y10T 70/5447; Y10T 70/5451; Y10T 70/5456; Y10T 70/546; Y10T 70/5465; Y10T 70/5469; Y10T 70/5473; Y10T 70/5482; Y10T 70/5491; Y10T 292/82; Y10T 292/91; Y10T 292/865; Y10T 292/85; E05B 13/004; E05B 13/002; E05B 3/065; E05B 63/0069; E05B 65/0035; E05C 1/163
See application file for complete search history.

(56) References Cited

U.S. PATENT DOCUMENTS 2,400,403 A 5/1946 Falk
2,420,114 A * 5/1947 Vander Henst ..... E05C 1/163 292/169.18
2,499,948 A * 3/1950 Egor ..... E05C 1/163 292/359
2,593,573 A * 4/1952 Kulbersh ..... E05C 1/163 292/169.16
2,605,124 A * 7/1952 Hillgren ..... E05C 1/163 292/169.18
2,653,047 A * 9/1953 Sultan ..... E05C 1/163 292/359
2,723,874 A * 11/1955 Hillgren ..... E05C 1/163 292/336.3
3,212,806 A * 10/1965 Russell ..... E05B 3/065 292/336.3
4,142,748 A 3/1979 Hook
4,143,529 A 3/1979 Brummett et al.
4,866,965 A 9/1989 Urdal
5,067,758 A 11/1991 Fann et al.
5,083,823 A 1/1992 Fann et al.
5,286,074 A 2/1994 Lin
5,505,508 A 4/1996 Kuo
5,562,317 A * 10/1996 Kuo ..... E05B 13/002 292/359
5,826,924 A 10/1998 Huang
5,941,108 A 8/1999 Shen
6,502,872 B1 * 1/2003 Molzer ..... E05B 13/106 292/336.3
6,553,799 B2 4/2003 Bates et al.
6,568,231 B1 5/2003 Huang
6,644,077 B1 11/2003 Huang
7,387,005 B2 * 6/2008 Huang ..... E05B 65/0035 292/336.3
7,900,978 B2 3/2011 Zimmer
8,047,586 B2 11/2011 Pilotelli
10,753,121 B2 8/2020 Morse et al.
2002/0105196 A1 8/2002 Furlong et al.
2004/0174023 A1 9/2004 Fishencord
2005/0046203 A1 * 3/2005 Huang ..... E05B 13/004 292/348
2005/0179267 A1 8/2005 Cote et al.
2005/0225097 A1 * 10/2005 Geringer ..... E05B 47/0657 292/144
2005/0262906 A1 12/2005 Romero et al.
2007/0068209 A1 * 3/2007 Huang ..... E05B 65/0035 70/467
2013/0269402 A1 10/2013 Vasudevan
2017/0275914 A1 9/2017 Murphy et al.
2021/0071441 A1 3/2021 Morse et al.

FOREIGN PATENT DOCUMENTS

CN 204826923 U 12/2015
EP 1717389 A1 * 11/2006 ..... E05B 13/004

OTHER PUBLICATIONS

International Search Report and Written Opinion for Application No. PCT/US2016/058983 dated Jan. 10, 2017.

* cited by examiner

PRIVACY LOCK

RELATED APPLICATION

This application is a continuation-in-part of U.S. application Ser. No. 15/333,662 filed Oct. 25, 2016 and now U.S. Pat. No. 10,753,121, and also claims the benefit of U.S. Provisional Application Ser. No. 62/250,201 filed Nov. 3, 2015 for a "Privacy Lock," both of which are hereby incorporated by reference in their entirety.

TECHNICAL FIELD

The present disclosure relates generally to locking devices. In particular, this disclosure relates to a privacy lock with an emergency exit feature.

SUMMARY

According to one aspect, the present disclosure relates to a privacy door lock with a lock assembly including a chassis having exterior and interior portions. A spindle extends between the exterior and interior portions to translate a door latch. An exterior spring housing and an interior spring housing may be coupled to the exterior and interior portions of the chassis. The interior spring housing and the exterior housing each have compression springs. A locking mechanism having a locking piece engages with a toggle offset from a central axis of the chassis to secure the lock assembly in a locked position. In some embodiments, the lock assembly provides means for unlocking the lock assembly from the interior portion by a camming motion so that the toggle is translated out of engagement with the locking piece, thereby allowing the locking piece to rotate with the spindle.

In illustrative embodiments, the lock assembly may include a chassis with an exterior and interior portion configured to extend from an exterior and interior of a door. A spindle may be provided that extends between the exterior and interior portion to translate a door latch bolt. An exterior spring housing and an interior spring housing may be coupled to the exterior and interior portions of the chassis. The interior spring housing and the exterior housing may each have compression springs. A locking mechanism may be provided having a locking piece that is keyed to engage with a toggle offset from a central axis of the chassis to secure the lock assembly in a locked position. The locking piece is keyed to receive a tail piece of the toggle. Translation of the tail piece out of the keyed locking piece unlocks the lock assembly into an unlocked position.

In another embodiment, a method of operating a door locking assembly includes providing a lock assembly chassis having an interior portion including compression springs and an exterior portion including compression springs, the interior portion and exterior portion connected via a spindle which translates a latch bolt. The door may be locked by pressing a lock actuator toggle, offset from an axis of rotation along the center of the chassis, into a keyed opening of a locking piece in the interior portion of the chassis. The door may be unlocked by camming the toggle out of the keyed opening of a locking piece.

Additional features of the present disclosure will become apparent to those skilled in the art upon consideration of illustrative embodiments including the best mode of carrying out the disclosure as presently perceived.

BRIEF DESCRIPTION OF THE FIGURES

The detailed description makes reference to the accompanying figures in which.

DETAILED DESCRIPTION

The disclosure generally relates to a privacy lock assembly. Privacy door locks are often used in bedrooms and/or bathrooms, but this disclosure is not intended to be limited to a particular room or location in which the lock is installed. The lock assembly can be locked by actuating a push button on the interior assembly. Depending on the circumstances, the unlocking button could be offset from, and not incorporated into the handle, which provides more flexibility in the handle's aesthetic design. The lock assembly can be unlocked solely by actuating the interior handle, which provides an emergency exit feature for users to easily unlock the lock assembly and exit a room. An emergency key is provided to unlock the lock assembly from the exterior assembly side. The lock assembly may incorporate spring housings to maintain interior and exterior handles in a predetermined orientation in the unloaded position.

Figure 1:
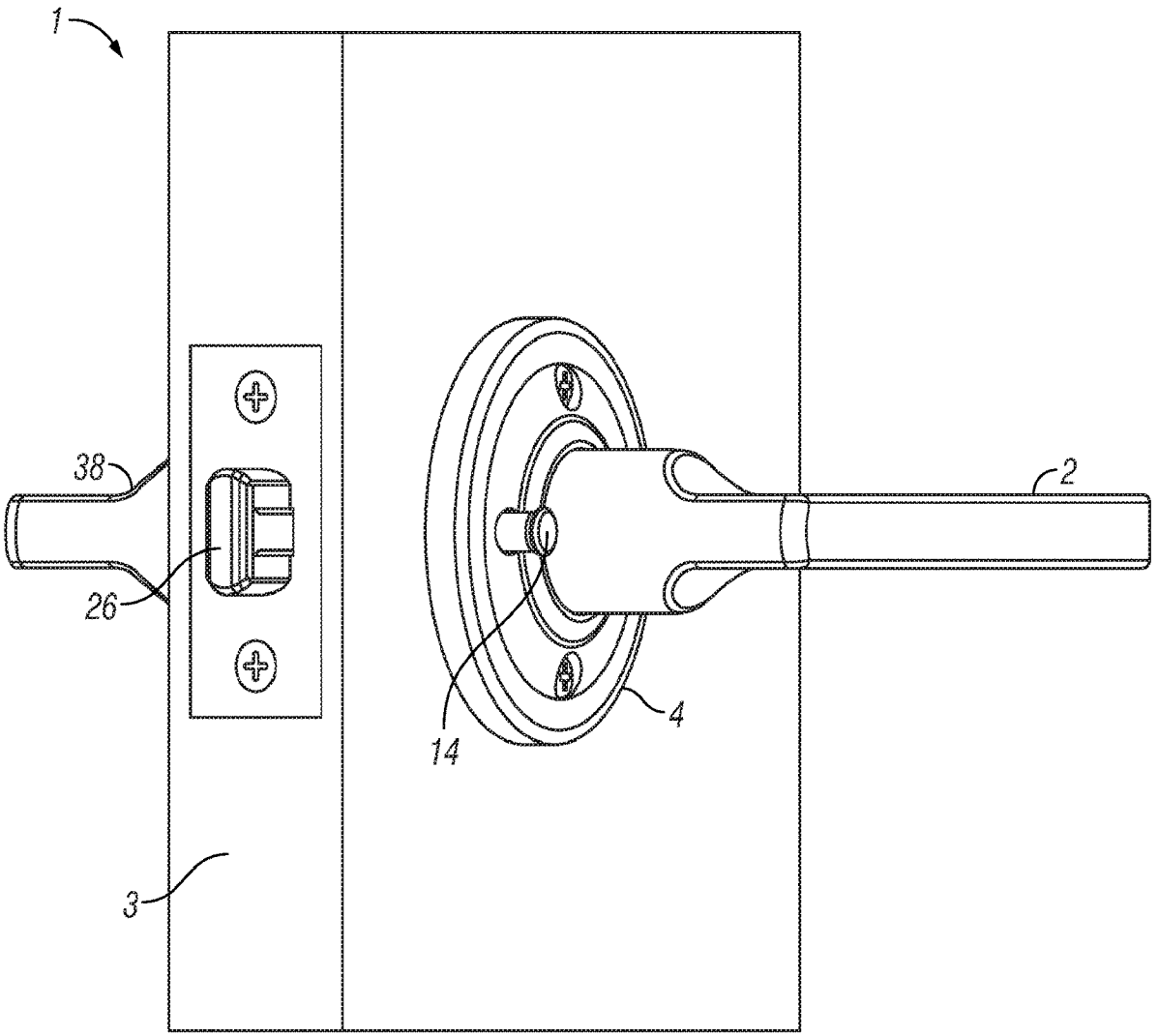
FIG. 1 is a perspective view of a cut away of a door on which a lock assembly according to an embodiment of the disclosure is installed.

FIG. 1 illustrates a privacy lock assembly 1 according to an embodiment of the present disclosure. In the example shown, the privacy lock assembly 1 includes an interior handle 2, an interior rose 4, and a button 14 arranged on an interior side of a door 3 opposite an exterior handle 38 mounted on an opposite side of the door 3. The interior rose 4 could be many different sizes and shapes depending on the desired aesthetic qualities of the lock assembly 1. The handles 2, 38 are shown as levers in FIG. 1 purposes of example, but could be embodied as knobs or other types of handles. When the privacy lock assembly 1 is in an unlocked position, a bolt 26 is operably movable by the interior and exterior handles 2, 38 between an extended and retracted position. As shown, the bolt 26 is in the extended position, but when the privacy lock assembly 1 is in the unlocked position, the rotation of either handle 2, 38 moves the bolt 26 to a retracted position. In the embodiment shown, the button 14 may be pushed to lock the lock assembly 1. In a locked position, the exterior handle 38 cannot actuate the bolt 26 to the retracted position. However, even in the locked position, the interior handle 2 can actuate the bolt 26 to the retracted position which is an emergency exit feature that allows a person to exit a room by solely activating the interior handle 2 to unlock the lock assembly 1. As shown, the button 14 is offset from an axis about which the interior handle 2 rotates. In the example shown, the button 14 extends through the interior rose 4.

Figure 2:
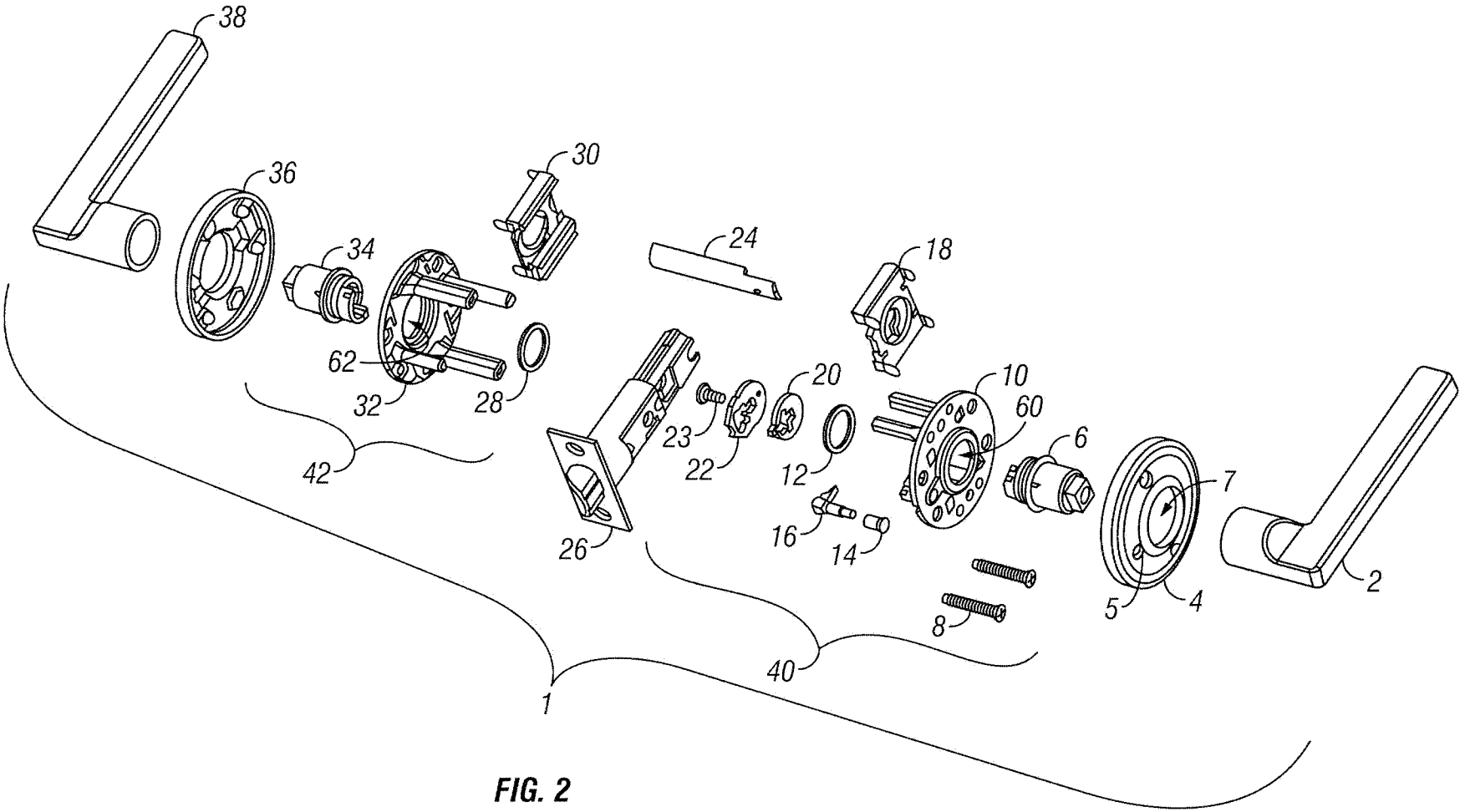
FIG. 2 is an exploded view of the example lock assembly shown in FIG. 1.

Referring to FIG. 2, the privacy lock assembly 1 includes an interior chassis 40 and an exterior chassis 42. The interior chassis 40 includes an interior insert 6 that extends through the opening 7 in interior rose 4 and into the interior handle 2. An interior liner 10 is received by a recessed area of the interior rose 4. The interior liner 10 also provides an opening 60 to receive an end of the interior insert 6. The interior insert 6 extends through the interior liner 10 and is retained in place by a clip 12. The interior rose 4 includes an opening 5 through which a button 14 extends in mating connection with toggle 16. As shown, the opening 5 is offset from an opening 7 through which handle 2 extends through rose 4. The interior spring housing 18 connects to interior liner 10 so that interior insert 6 extends into and through the interior spring housing 18. An unlocking piece 20 and a locking piece 22 are mounted to the interior insert 6 via fastener 23.

The exterior chassis 42 includes an exterior insert 34 that extends through the exterior rose 36 and into the exterior handle 38. The exterior liner 32 nests in the exterior rose 36 and also provides an opening 62 to receive an end of the exterior insert 34. A clip 28 couples the exterior insert 34 to the exterior liner 32. The opposite end of the exterior insert 34 extends through the rose 36 and is coupled with the exterior handle 38. An exterior spring housing 30 connects to the exterior insert 34 so that exterior insert 34 extends into and through the exterior spring housing 30. A spindle 24 is configured to mate in the opening 60 of interior insert 6 and the opening 62 in exterior insert 34 and extend through the latch assembly 26 to control locking and unlocking. The locking assembly includes mounting fasteners 8, that extend through openings in the interior rose 4 and threadingly engage with interior openings in the exterior rose 36.

Figure 3:
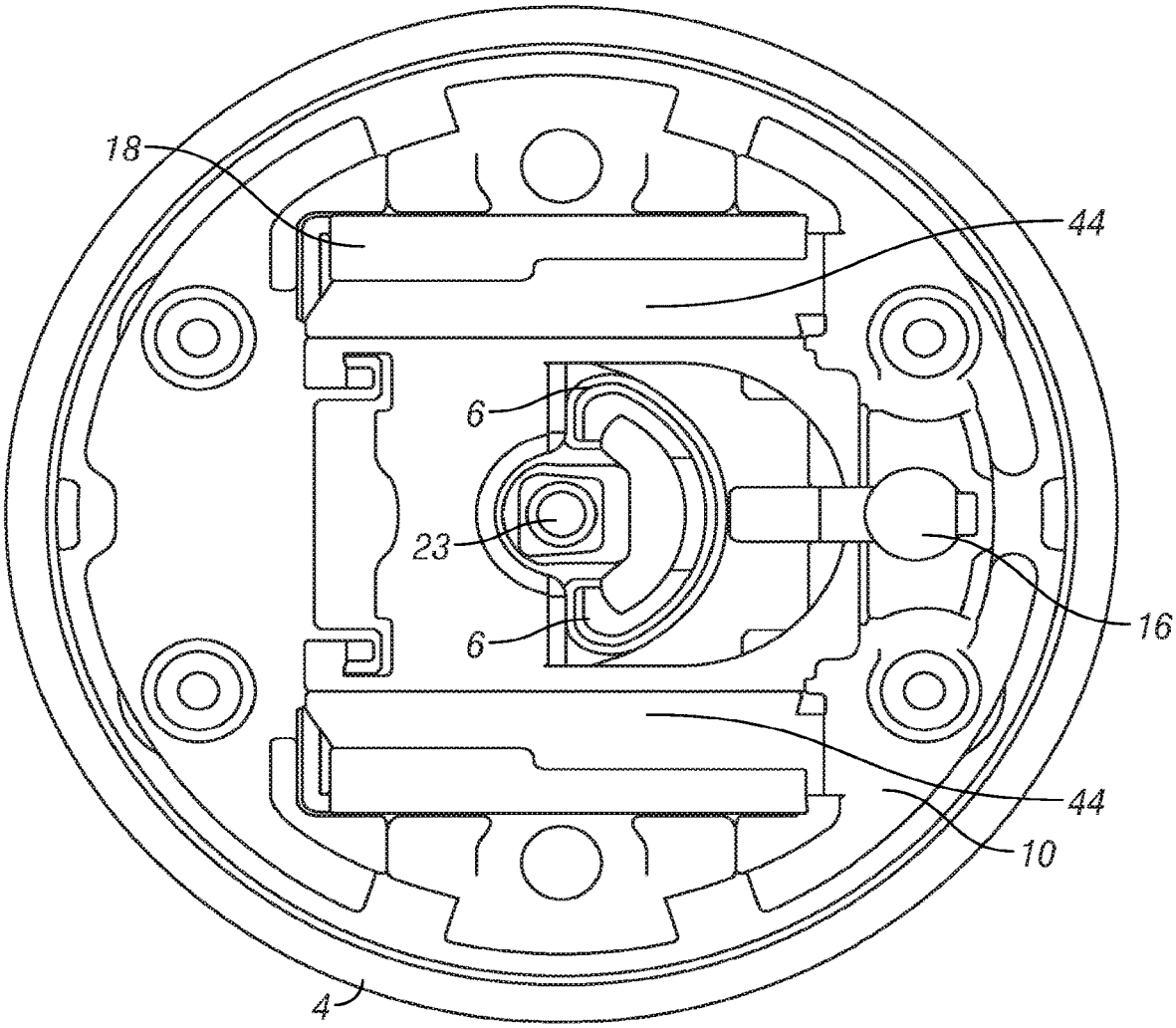
FIG. 3 is a rear view of the interior chassis of the example lock assembly shown in FIG. 1.
Figure 4:
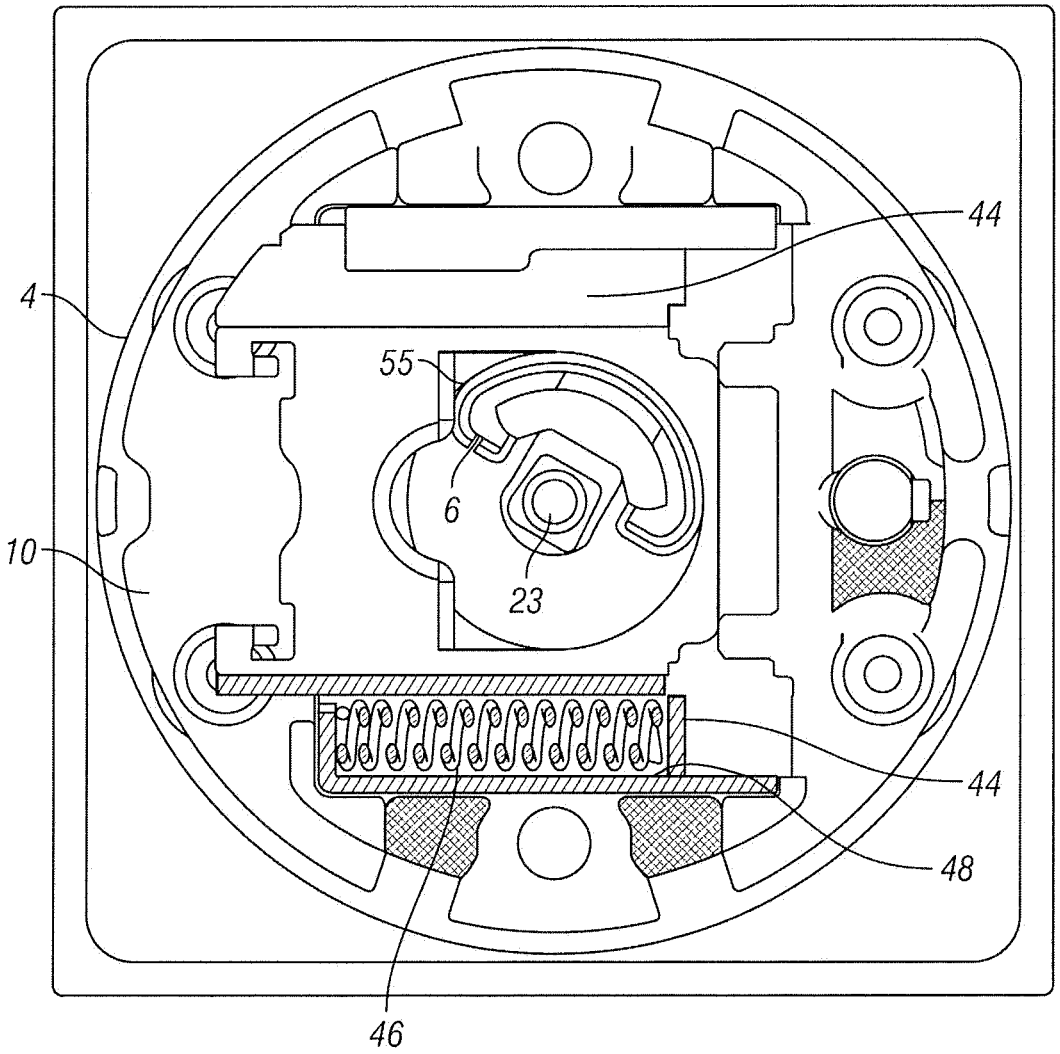
FIG. 4 is a rear cross-sectional view of the interior chassis with a partial cutaway of the interior spring housing of the example lock assembly shown in FIG. 1.
Figure 5:
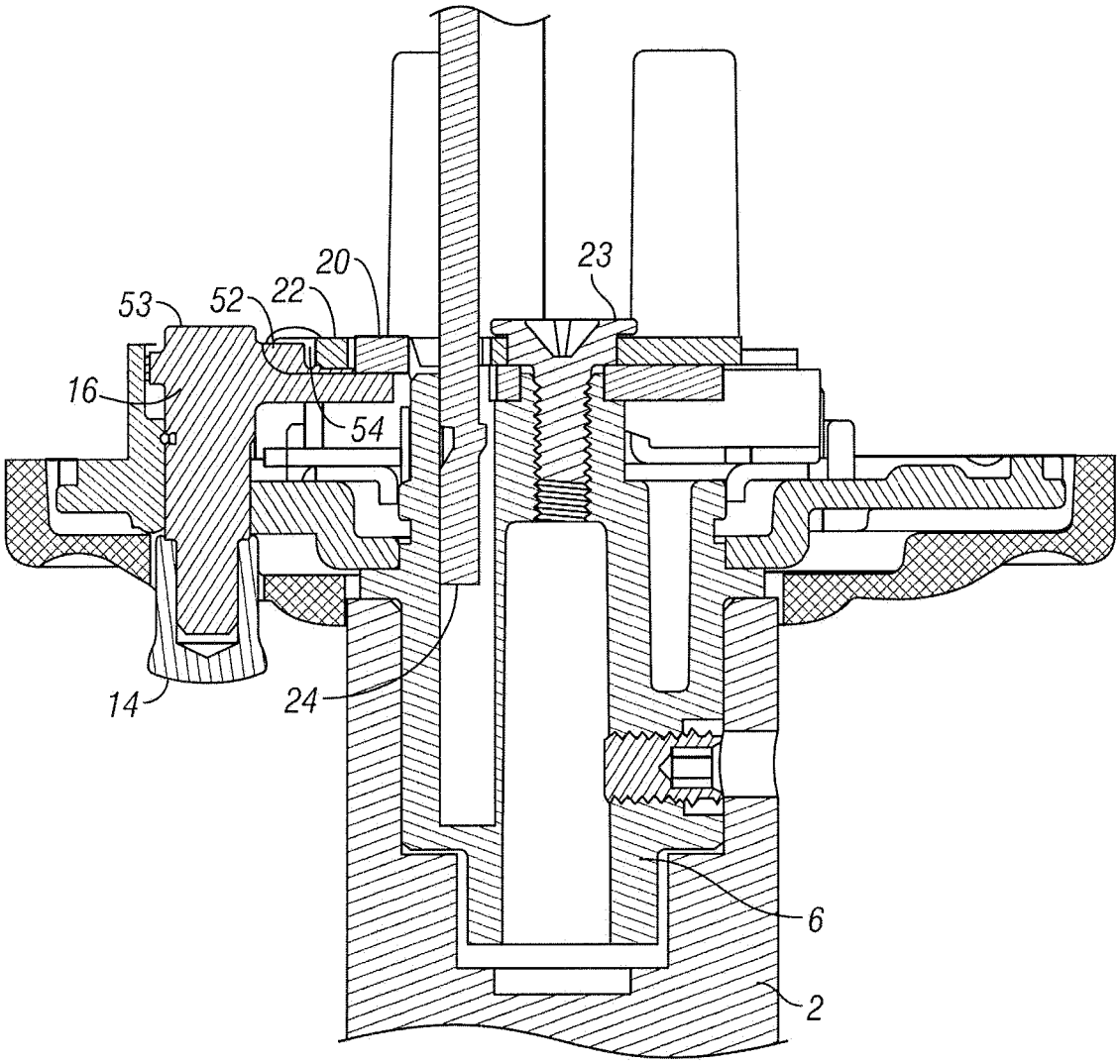
FIG. 5 is a top cross-sectional view of the lock assembly of FIG. 1 in the locked position.

Referring to FIGS. 3-5, the interior spring housing 18 includes a translating spring compressing plate 44 and an opening 54 (FIG. 5) with a portion proximate where the fastener 23 is positioned when no external load is applied to the interior handle 2 or exterior handle 38. The internal orientation as shown in FIG. 3, corresponds to a predetermined orientation of interior and exterior handles 2, 38 without a load such as the orientation shown in FIG. 1.

FIG. 4 illustratively shows the interior spring housing 18 when an external load or force is applied to the interior and/or exterior handles 2, 38 (e.g., when a user rotates the handle 2). As can be seen, the interior insert 6 rotates in response to such a force so that the spring compressor plate 44 translates along a track provided by the interior spring housing 18 and top compressing walls 48 compress springs 46 in the housing. The springs 46, as shown in this embodiment, include a pair of compression springs in each spring housing 18, 30.

In the embodiment shown, springs 46, lie above and below predetermined horizontal axis of handle 2. This results in equal force applied by each spring 46 on each side of the handle 2 and ensures a precise unloaded orientation. However, it is contemplated that more than a pair of springs in each spring housing may be employed. In a rotated loaded position, the interior insert 6 contacts a wall 55 of opening (FIG. 4). An equivalent rotation of the external insert 43 and corresponding translation of an exterior spring compressor plate (not shown) occurs in exterior spring housing 30 due to the connection of the interior and exterior inserts via the spindle 24. The interior insert 6 is configured to have a predetermined amount of rotation in either direction where it does not engage the rotation of the spindle 24. Therefore, the interior insert 6 can rotate to return to the predetermined orientation by urging of compression springs 46 without engaging further rotation of the spindle 24.

When an applied load is removed from the handles 2, 38, (e.g., when a user releases the handle) the energy stored in the compressed springs 46 of the interior and exterior spring housings 18, 30 will expand and force spring compressor plate 44 to translate back to the initial position, thereby rotating interior and exterior inserts 6, 34 back to initial unloaded positions as seen in FIG. 3. This will result in corresponding rotation of internal and external handles 2, 38 to initial unloaded positions described above.

Figure 6:
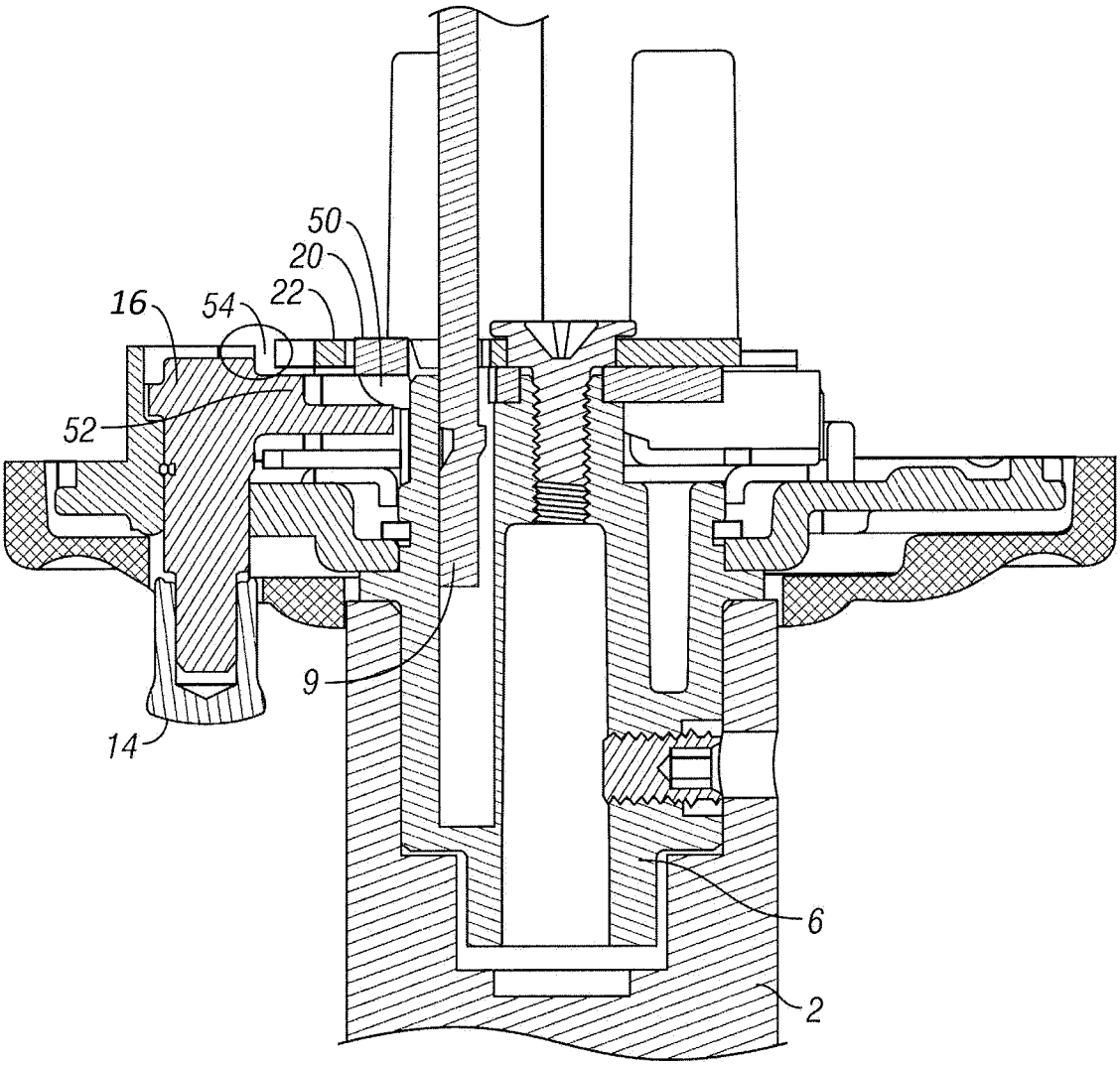
FIG. 6 is a top cross-sectional view of the lock assembly of FIG. 1 in the unlocked position.
Figure 7:
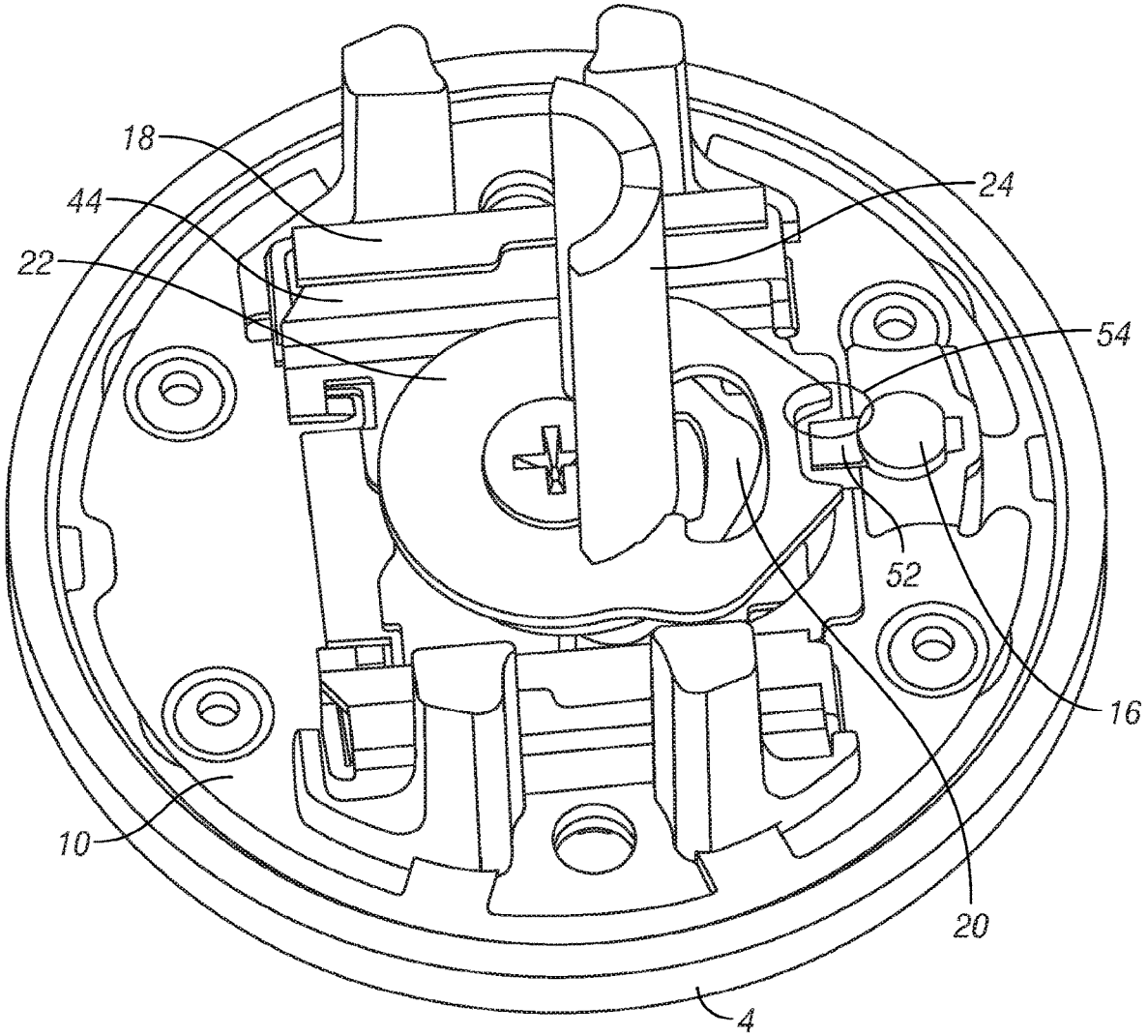
FIG. 7 is a rear perspective view of the interior chassis of the lock assembly of FIG. 1 in the unlocked position.

As shown in FIGS. 5-7, the privacy lock assembly 1 may also be locked or unlocked via the internal chassis 40. FIG. 5 illustrates the lock assembly 1 in a locked position. In this position toggle 16, which includes a head 53 and a tail 52, is translated into a keyed opening or notch 54 in locking piece 22. The translation can be actuated by button 14 that mates with toggle 16. In one embodiment, the button 14 is laterally offset from and parallel to the longitudinal axis of the interior insert 6, spindle 24 and/or, and the longitudinal axis of the portion of the handle that is inserted through the interior rose 4. When the tail 52 is located in the notch 54, the locking piece 22 is unable to rotate and is in a locked position. This locked configuration prevents the spindle 24 from rotating, which in turn, prevents rotation of the exterior handle 38. (The interior insert 6 can still rotate when the spindle 24 is locked).

In an unlocked configuration, ramped segment 50 of unlocking piece 20 is rotated to contact a distal end of tail 52 of toggle 16. This results in translation of toggle tail 52 out of notch 54 as seen in FIGS. 6-7. This translates toggle 16 out of and away from notch 54.

To rotate the ramped portion 50 of the unlocking plate 20 to displace the toggle 16 as illustrated, a user merely has to rotate the internal handle 2. The unlocking piece 20 is configured to rotate with interior insert 6. This provides an emergency exit feature in which the user can unlock the lock assembly 1 by turning the interior handle 2. Alternatively, a user at the interior handle 2 could pull the button 14 away from the interior rose 4.

As seen in FIG. 7, when in the unlocked configuration the tail 52 of toggle 16 is displaced out of, and in a different plane than, notch 54 of locking piece 22. As a result, rotation of spindle 24, i.e. an exterior load applied, may now cause the locking piece 22 to rotate along with the unlocking piece 20. In this configuration, the door, now unlocked, will permit spindle 24 to rotate when forces are applied to the exterior and or interior handles 2, 38.

Figure 8:
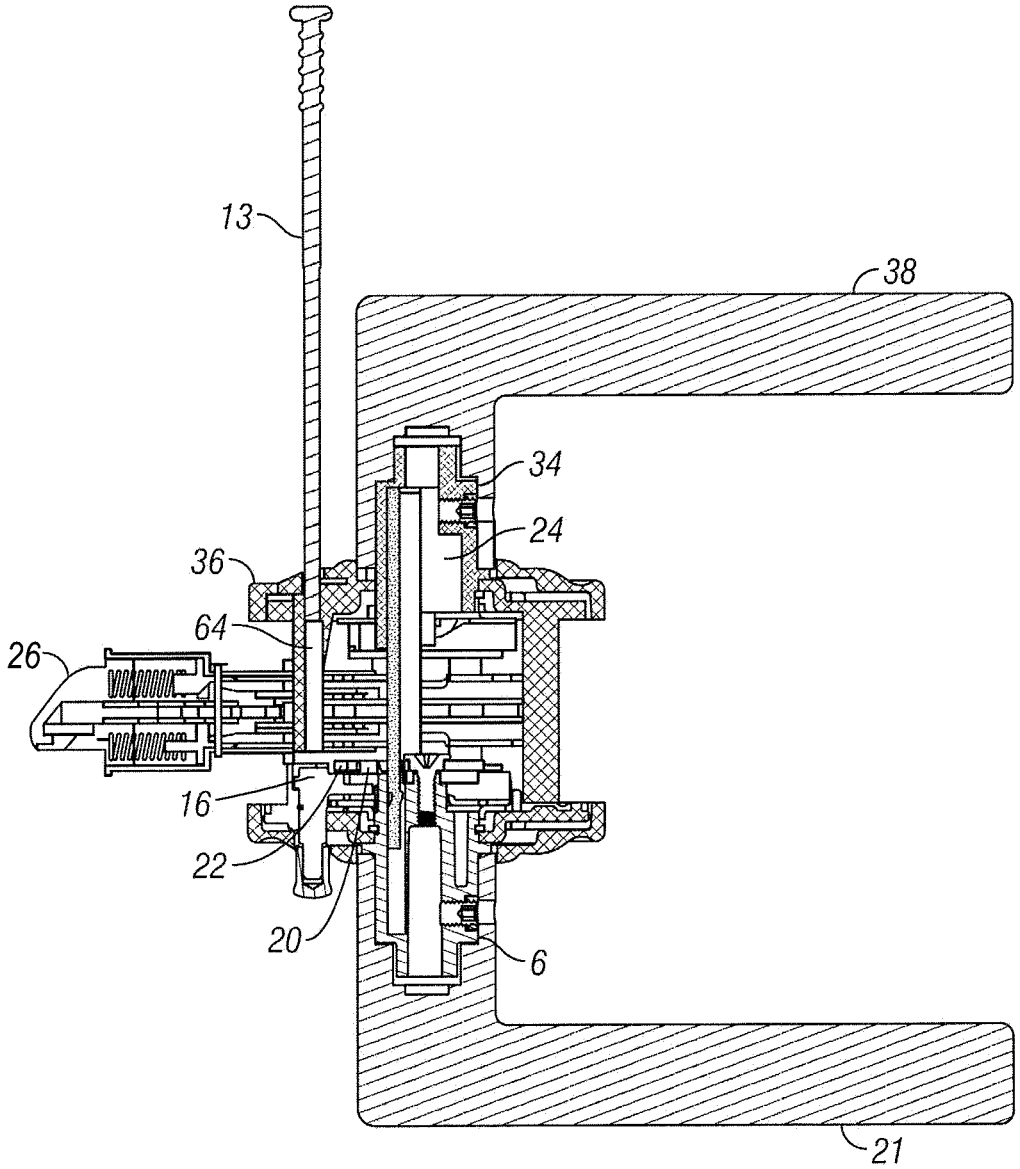
FIG. 8 is a top cross-sectional view of the interior chassis of the lock assembly of FIG. 1 with a tool inserted to unlock the lock assembly.

The lock assembly 1 can be unlocked from the exterior assembly side as illustrated in FIG. 8. A tool 13 may be provided that is configured to slidingly be deployed into a channel 64 extending through the exterior chassis 42 from the exterior rose 36. Channel 64 aligns with head 53 of toggle 16. Force applied by tool 13 to head 53 translates the toggle 16 so that the tail 52 translates out of the notch 54. This results in an unlocked configuration where the locking piece 22 can rotate along with the unlocking piece 20.

Figure 9:
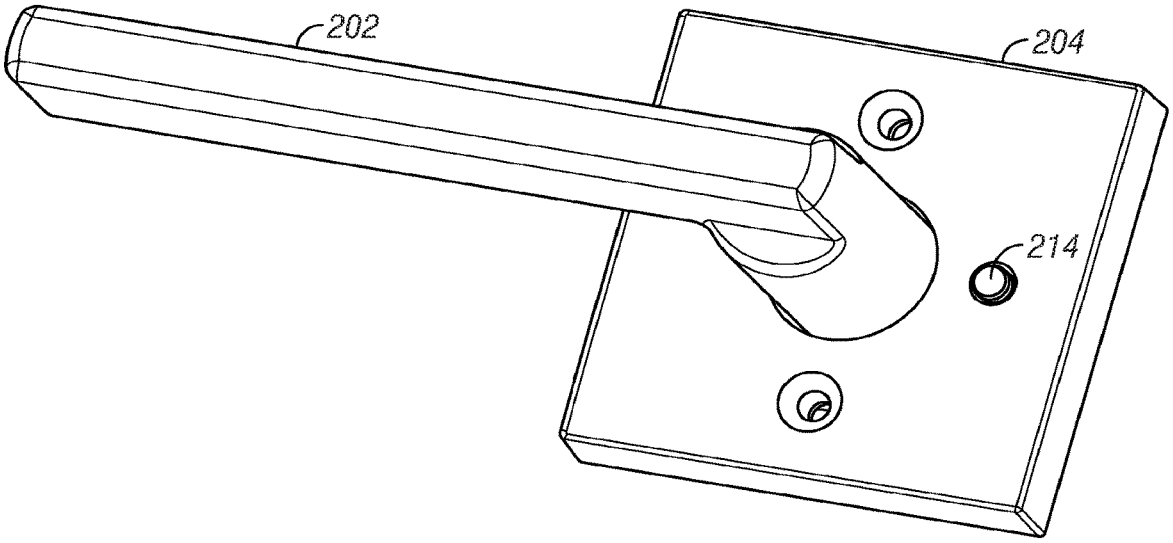
FIG. 9 is a front perspective view of another example interior chassis for use in lock assembly according to an embodiment of the disclosure.
Figure 10:
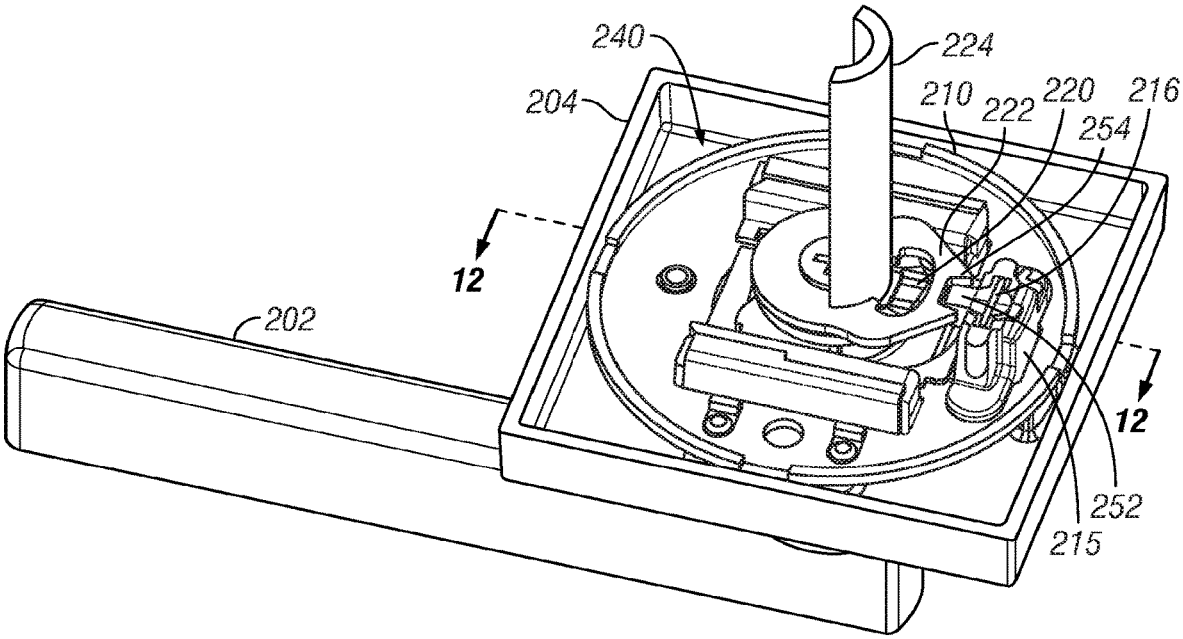
FIG. 10 is a rear perspective view of the interior chassis of FIG. 9.

FIG. 9 illustrates an interior handle 202, an interior rose 204, and a button 214 coupled to another example of an interior chassis 240, as shown in FIG. 10, for use in a privacy lock assembly according to an embodiment of the present disclosure. The interior chassis 240 operates in a similar manner to that of interior chassis 40 when used in a lock assembly, such as the lock assembly 1. The discussion above with regard to interior chassis 40 in the operation of lock assembly 1 applies equally to interior chassis 240, and structural and functional differences between interior chassis 40 and interior chassis 240 are addressed below.

Referring to FIG. 10, an interior liner 210 is received by a recessed area of the interior rose 204. The interior liner 210 also provides an opening 260 (seen in FIG. 13) to receive an end of an interior insert 206. The interior insert 206 extends through the interior liner 210 and is retained in place by a clip. An opposing end of the interior insert 206 engages with the interior handle 202. The button 214 extends in mating connection with a toggle 216. An unlocking piece 220 and a locking piece 222 are mounted to the interior insert 206 via fastener 223 (seen in FIG. 12). A spindle 224 is configured to cooperate with the unlocking piece 220 and the locking piece 222 to control locking and unlocking. The interior insert 206 is configured to have a predetermined amount of rotation in either direction where it does not engage the rotation of the spindle 224.

Figure 12:
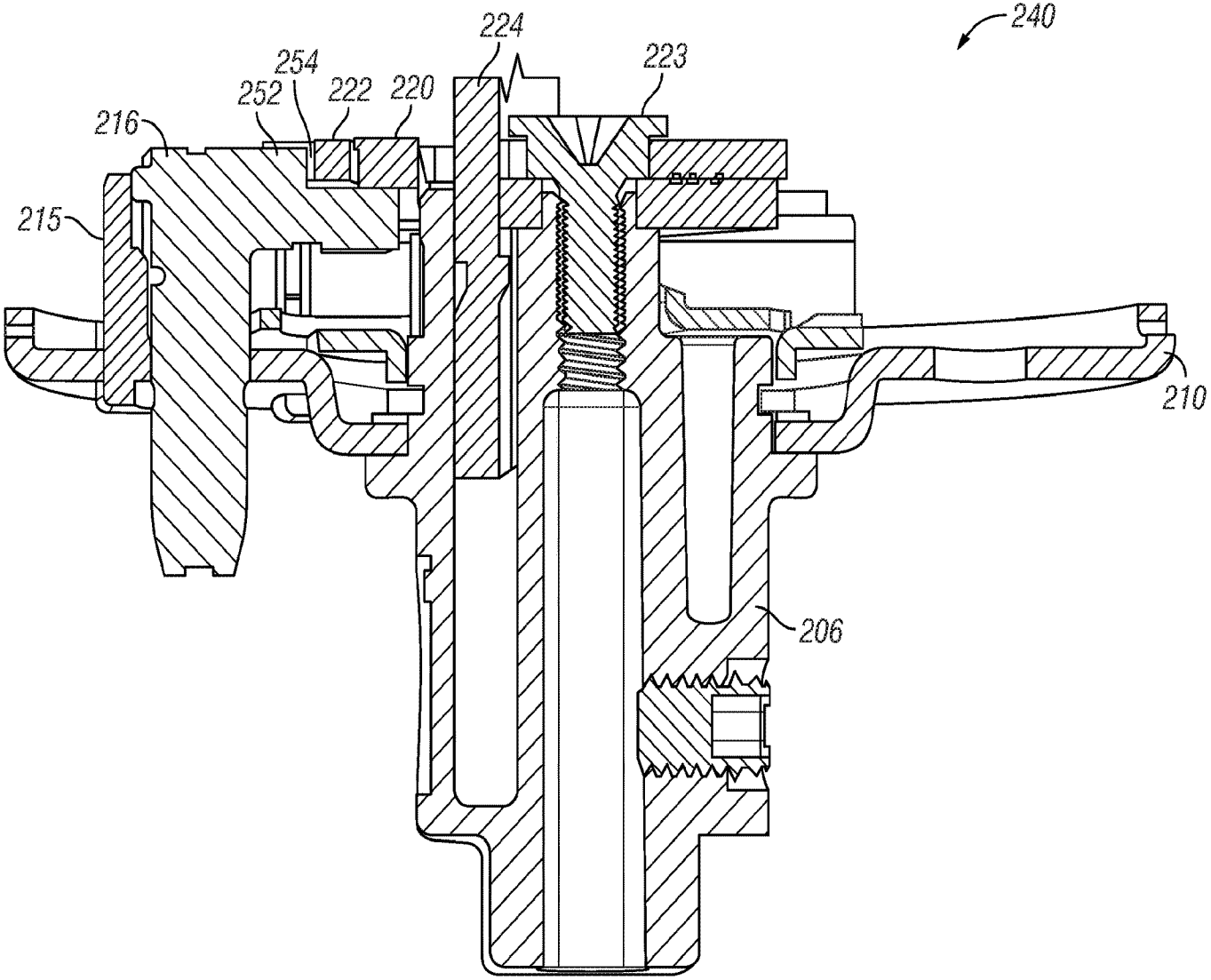
FIG. 12 is a top cross-sectional view of the interior chassis of FIG. 10.

A privacy lock assembly including interior chassis 240 may be locked or unlocked via the toggle 216. FIGS. 10 and 12 illustrate the toggle 216 in a locked position. In this position, a tail 252 of toggle 216 is translated into a keyed opening or notch 254 in locking piece 222. The translation can be actuated by button 214 that mates with toggle 216. When the tail 252 is located in the notch 254, the locking piece 222 is unable to rotate and is in a locked position. This locked configuration prevents the spindle 224 from rotating, which in turn, prevents rotation of an exterior handle of the lock assembly. The interior insert 206 can still rotate when the spindle 224 is locked as further detailed below.

Figure 11:
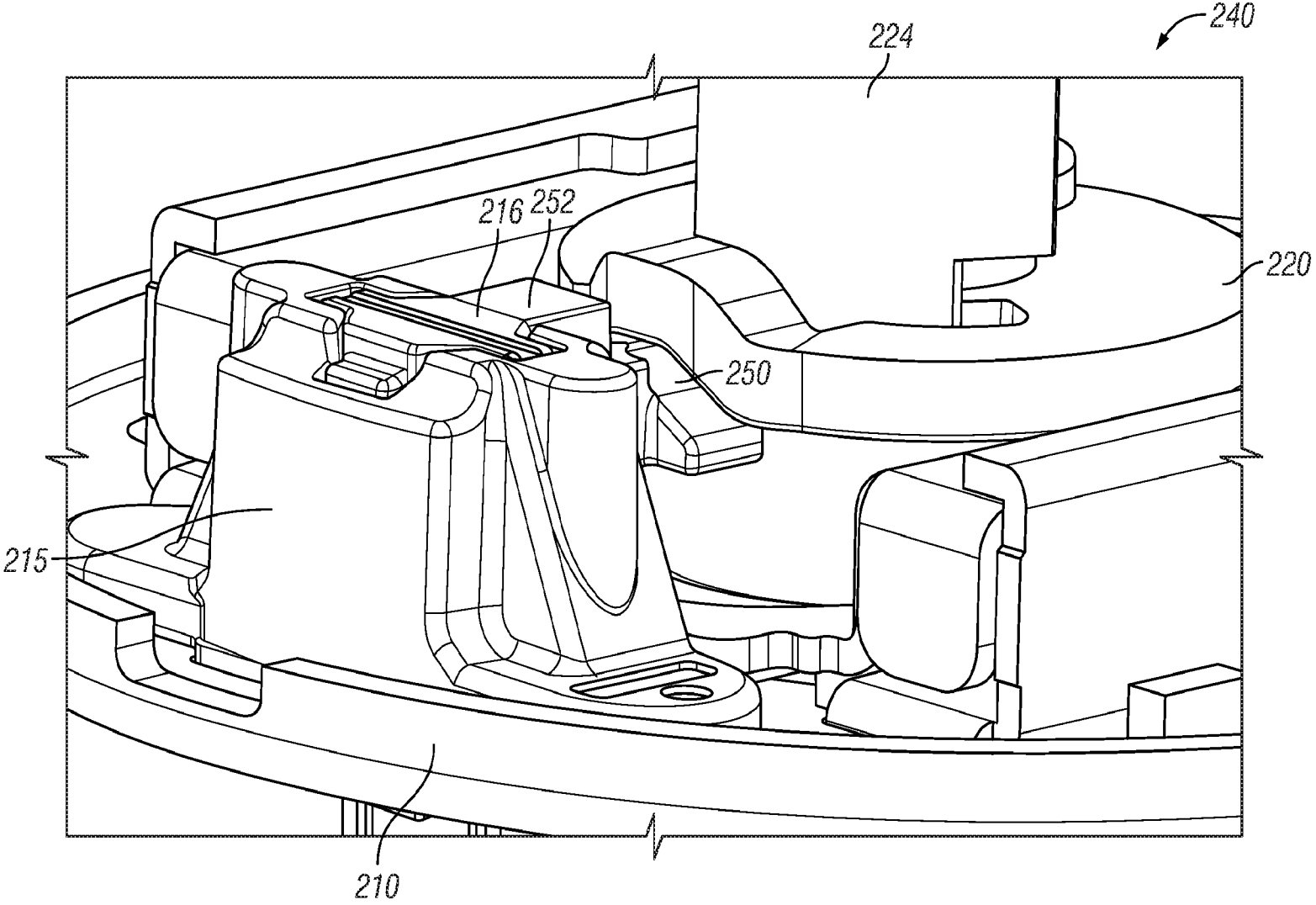
FIG. 11 is an enlarged view of the interior chassis of FIG. 10.

As shown in FIG. 11, a ramped portion of toggle 216 is aligned with unlocking piece 220 when toggle 216 is in the locked position. Rotation of interior handle 202 causes rotation of unlocking piece 220 to engage unlocking piece 220 with ramped portion 250. This results in translation of tail 252 out of notch 254 and translates toggle 216 to an unlocked position. Alternatively, a user at the interior handle 202 could pull the button 214 away from the interior rose 204. The exterior handle may then be used to operate the lock assembly and open the door.

Figure 13:
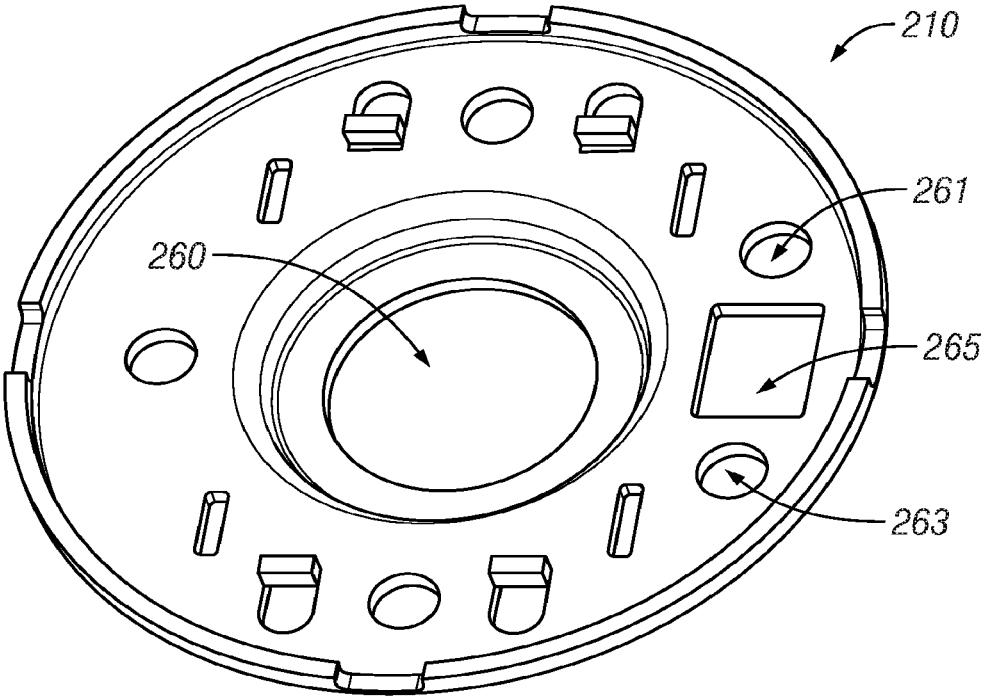
FIG. 13 is a rear perspective view of an example of an interior liner of the interior chassis of FIG. 10.
Figure 14:
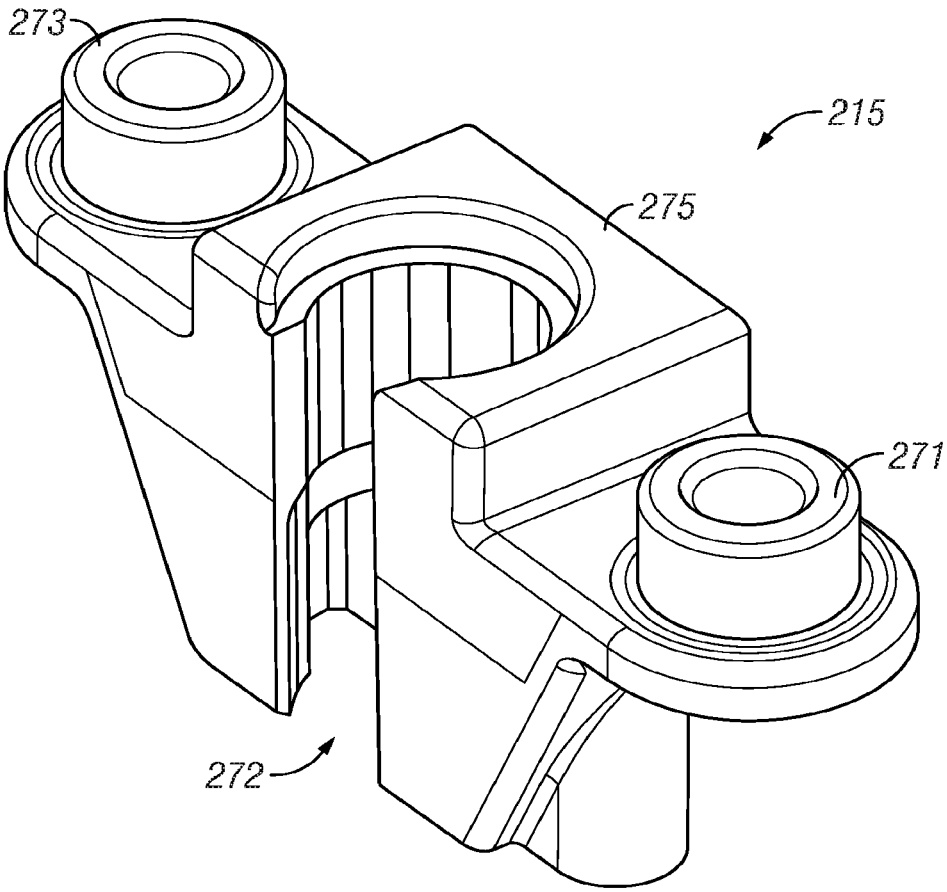
FIG. 14 is a front perspective view of an example of a toggle mount of the interior chassis of FIG. 10.
Figure 15:
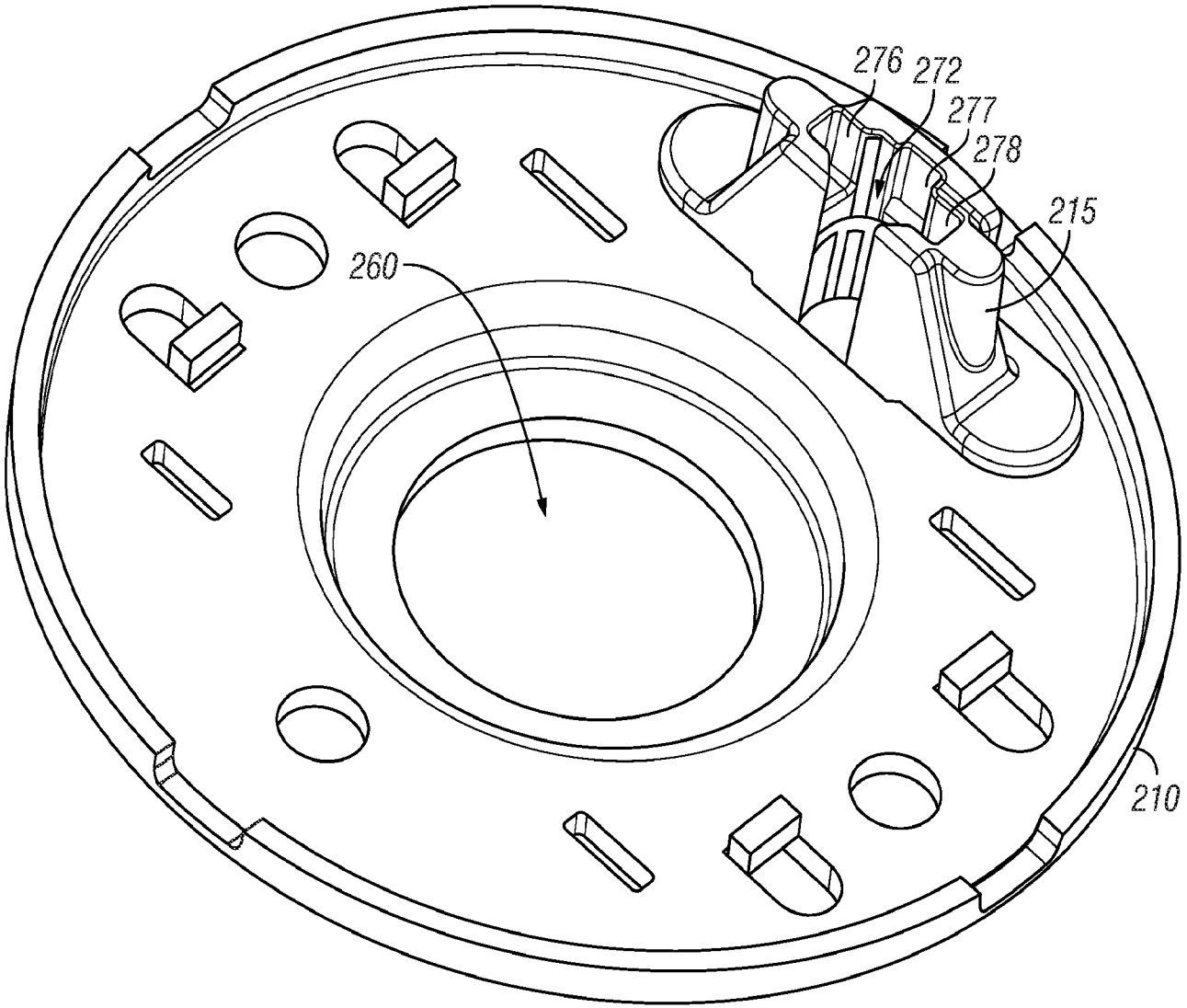
FIG. 15 is a rear perspective view of the interior liner of FIG. 13 with the toggle mount of FIG. 14 coupled thereto.

As seen in FIG. 13, interior liner 210 is formed from a strong yet low cost stamped component. In the illustrative embodiment, the interior liner 210 can be formed from steel or other metal. The interior liner 210 is formed to include the opening 260, attachment holes 261, 263, and an aperture 265. A toggle mount 215 (seen in FIG. 14) includes a base 275, attachment posts 271, 273, and a toggle receiver 272. As suggested in FIGS. 13-15, the attachment posts 271, 273 align with the attachment holes 261, 263, and the base 275 aligns with the aperture 265, to couple the toggle mount 215 with the interior liner 210. The interior liner 210 and toggle mount 215 increase strength and lower cost compared to a single-piece cast component made from zinc, for example.

Figure 16:
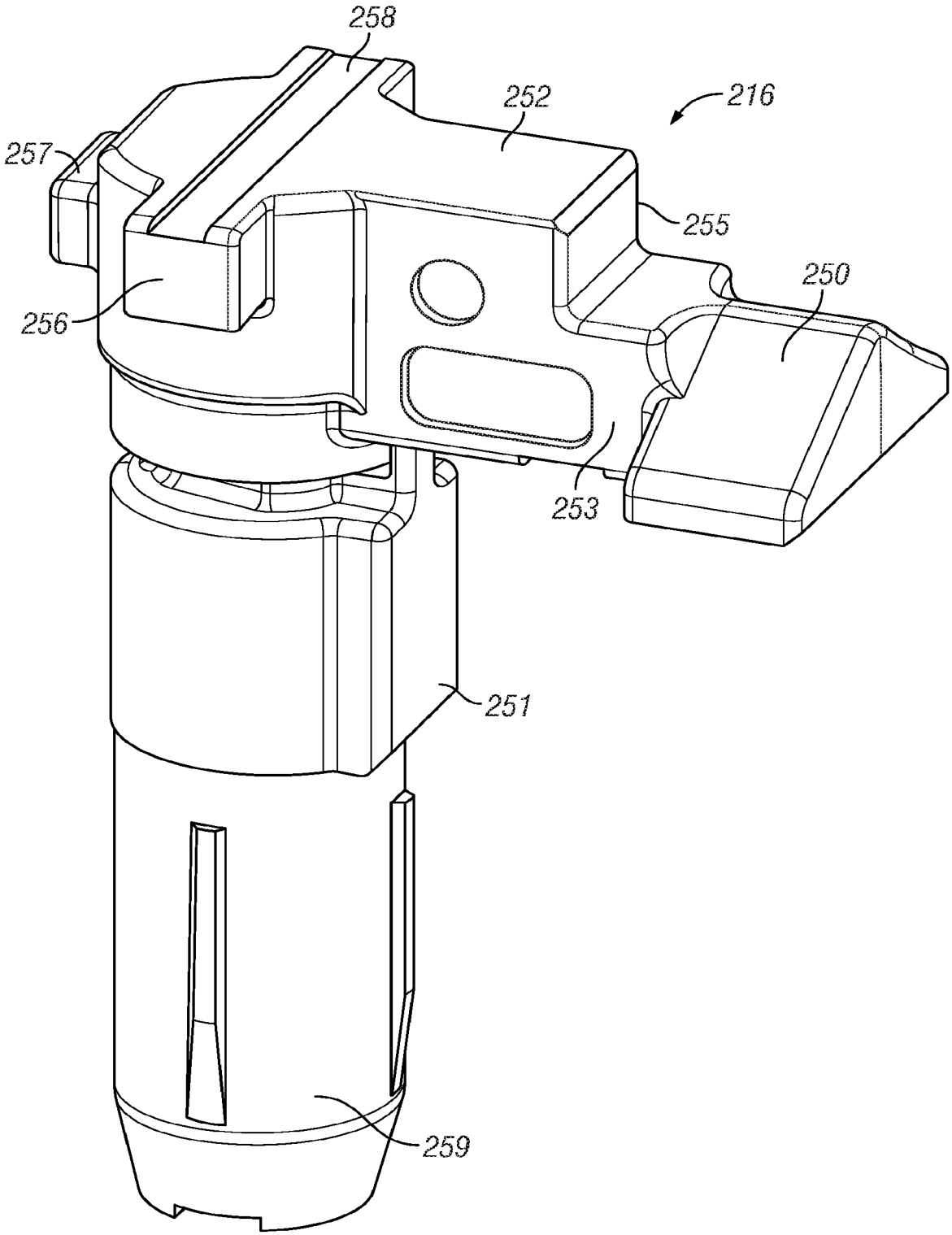
FIG. 16 is a top perspective view of an example of a toggle of the interior chassis of FIG. 10.

As seen in FIG. 16, the ramped portion 250 of toggle 216 extends past outer surfaces 253, 255 of tail 252 to maximize contact surface area of ramped portion 250 for minimizing wear of ramped portion when engaged with unlocking piece 220. Toggle 216 also includes alignment wings 256, 257, 258 and a runner 251. An outer end 259 of toggle 216 is configured to engage with button 214. The outer end 259 extends through toggle receiver 272 of toggle mount 215 as suggested in FIGS. 12 and 15. Grooves 276, 277, 278 engage with alignment wings 256, 257, 258 to block rotation of toggle 216 relative to toggle mount 215 and interior liner 210 during movement of the toggle 216 between the locked and unlocked positions. The runner 251 rides in a slot defined by toggle receiver 272 to also block rotation of toggle 216. In some embodiments, toggle 216 is formed from a softer metal, such as zinc, and unlocking piece 220 is formed from a harder metal, such as steel.

EXAMPLES

Illustrative examples of the privacy lock disclosed herein are provided below. An embodiment of the privacy lock may include any one or more, and any combination of, the examples described below.

In one example, an interior chassis of a lock assembly includes a liner, a separately formed toggle mount coupled to the liner, a toggle received in the toggle mount, and a locking piece. The toggle is configured to translate relative to the toggle mount between a locked position engaged with the locking piece to block rotation of the locking piece and an unlocked position spaced apart from the locking piece to allow rotation of the locking piece.

In some examples, the interior chassis further includes an unlocking piece and the unlocking piece is configured to translate the toggle to the unlocked position in response to rotation of the unlocking piece.

In some examples, the toggle includes a tail and a ramped portion coupled to the tail. The tail engages with the locking piece when the toggle is in the locked position to block rotation of the locking piece. The ramped portion engages with the unlocking piece to translate the toggle to the unlocked position in response to rotation of the unlocking piece.

In some examples, the tail defines opposing outer surfaces, and the ramped portion extends past the outer surfaces.

In some examples, the toggle includes at least two alignment wings configured to engage with grooves of the toggle mount to block rotation of the toggle during translation of the toggle between the locked and unlocked positions.

In some examples, the toggle further includes a runner configured to engage with a slot of the toggle mount to block rotation of the toggle during translation of the toggle between the locked and unlocked positions.

In some examples, the liner is formed by stamping and the toggle mount is formed by casting.

In some examples, the liner is formed from steel and the toggle mount is formed from zinc.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

The invention claimed is:

1. An interior chassis of a lock assembly having an interior handle, the interior chassis comprising:

a rose;

a liner positionable within the rose;

a toggle mount fastened to the liner, the toggle mount being a separate component from the liner and formed from a different material than the liner;

a toggle at least partially received inside of the toggle mount, wherein the toggle includes a first end and an opposite second end, the second end having a portion of the toggle that is at least partially surrounded by the toggle mount to prevent relative rotation between the toggle and the toggle mount, the first end extending through the liner and the second end further having a radially extending tail and a ramped portion disposed at a distal end of the tail, the tail at least partially extending out of the toggle mount, wherein the portion of the toggle that is at least partially surrounded by the toggle mount includes a plurality of radially extending alignment wings, one of the plurality of alignment wings positioned opposite from and extending in an opposite direction relative to the tail, two of the plurality of alignment wings extending in opposite directions relative to each other, and wherein the tail is disposed between the plurality of alignment wings and the ramped portion;

a locking piece coupled to an exterior handle for rotation therewith;

wherein the toggle is configured to translate relative to the toggle mount between a locked position, in which the tail of the toggle is engaged with the locking piece to block rotation of the locking piece and thereby the exterior handle, and an unlocked position, in which the tail of the toggle is spaced apart from the locking piece to allow rotation of the locking piece and thereby the exterior handle; and an unlocking piece having a ramped recess to cooperate with the ramped portion of the toggle to translate the toggle towards the unlocked position in response to rotation of the unlocking piece about a rotational axis by the interior handle, wherein the ramped recess opens in a direction parallel to the rotational axis so as to receive and overlap at least a portion of the ramped portion of the toggle, and wherein the ramped portion of the toggle faces away from the first end of the toggle in an axial direction.

2. The interior chassis of claim 1, wherein the tail defines opposing outer surfaces, and wherein the ramped portion extends past the outer surfaces.

3. The interior chassis of claim 1, wherein the plurality of alignment wings are configured to engage grooves of the toggle mount to prevent rotation of the toggle relative to the toggle mount during translation of the toggle between the locked and unlocked positions.

4. The interior chassis of claim 3, wherein the toggle further includes a runner configured to engage with a slot of the toggle mount to prevent rotation of the toggle relative to the toggle mount during translation of the toggle between the locked and unlocked positions, the runner disposed between the tail and the first end of the toggle.

5. The interior chassis of claim 1, wherein the liner is formed by stamping and the toggle mount is formed by casting.

6. The interior chassis of claim 5, wherein the liner is formed from steel and the toggle mount is formed from zinc.

7. The interior chassis of claim 1, wherein the toggle mount includes:

a base having features that mate with the liner; and a toggle receiver disposed in the base.

8. The interior chassis of claim 1, wherein, when the toggle is in the locked position, the rotation of the unlocking piece causes translation of the toggle only to the unlocked position.

9. The interior chassis of claim 1, wherein the liner has a pair of toggle mount attachment holes, and wherein the toggle mount is fastened to the liner via attachment posts that align with the toggle mount attachment holes of the liner.

10. The interior chassis of claim 9, wherein the liner further includes an aperture between the pair of toggle mount attachment holes and the toggle mount includes a base, wherein the base aligns with the aperture to fasten the toggle mount to the liner.

11. The interior chassis of claim 1, wherein the liner is positionable within the rose by being received by a recessed area of the rose.

12. A lock assembly comprising:

an exterior portion and an interior portion configured to extend from an exterior and an interior of a door, respectively, and wherein the exterior and interior portions each include exterior and interior inserts, respectively;

a spindle extending between the exterior and interior portions to translate a door latch, the exterior and interior portions being configured to operatively connect the spindle to an exterior handle and an interior handle, respectively;

an exterior spring housing and an interior spring housing coupled to the respective exterior and interior portions, the exterior spring housing and the interior spring housing each having compression springs configured to bias the exterior and interior handles;

a rose;

a toggle mount fastened to a liner of the interior portion, wherein the liner is positionable within the rose, the toggle mount being a separate component from the liner and formed from a different material than the liner, the toggle mount including:

a base having features that mate with the liner of the interior portion; and a toggle receiver disposed in the base;

a locking mechanism having a locking piece positioned at the interior portion;

a toggle offset from a central axis of the exterior and interior portions, wherein the toggle includes a first end and an opposite second end, the second end having a portion of the toggle that is at least partially surrounded by the toggle mount to prevent relative rotation between the toggle and the toggle mount, wherein the portion of the toggle is movably received inside of the toggle receiver to guide translation of the toggle relative to the toggle mount, wherein the first end extends through the liner and the second end further having a radially extending tail and a ramped portion disposed at a distal end of the tail, the tail at least partially extending out of the toggle mount, wherein the portion of the toggle that is at least partially surrounded by the toggle mount includes a plurality of radially extending alignment wings, one of the plurality of alignment wings positioned opposite from and extending in an opposite direction relative to the tail, two of the plurality of alignment wings extending in opposite directions relative to each other, the tail of the toggle being engagable with the locking piece of the locking mechanism to secure the lock assembly in a locked state, and wherein the tail is disposed between the plurality of alignment wings and the ramped portion; and an unlocking piece positioned at the interior portion, the unlocking piece operatively connected to the interior insert and configured to receive the spindle therein, wherein, when the interior handle is actuated, the spindle will rotate the unlocking piece about a rotational axis, transferring a camming motion to the ramped portion of the toggle so that the toggle is translated to an unlocked position, the unlocking piece having a ramped recess to translate the toggle to the unlocked position in response to rotation of the unlocking piece about the rotational axis by the spindle, wherein the ramped recess opens in a direction parallel to the rotational axis so as to receive and overlap at least a portion of the ramped portion of the toggle, and wherein the ramped portion of the toggle faces away from the first end of the toggle in an axial direction.

13. The lock assembly of claim 12, wherein the features of the base of the toggle mount that mate with the liner of the interior portion are attachment posts that extend from the base.

14. The lock assembly of claim 13, wherein the attachment posts align with holes of the liner of the interior portion.

15. The lock assembly of claim 12, wherein, when the lock assembly is in the locked state, the tail of the toggle is engaged with the locking piece to block rotation of the locking piece, thereby blocking actuation of the exterior handle, and, when the lock assembly is in an unlocked state, the tail of the toggle is spaced apart from the locking piece so as to allow rotation of the locking piece, thereby, allowing actuation of the exterior handle.

16. The lock assembly of claim 12, wherein the liner is formed by stamping and the toggle mount is formed by casting.

17. The lock assembly of claim 12, wherein the liner is formed from steel and the toggle mount is formed from zinc.

18. The lock assembly of claim 12, wherein, when the toggle is in a locked state, the rotation of the unlocking piece causes translation of the toggle only to a unlocked position.

19. The lock assembly of claim 12, wherein the liner is positionable within the rose by being received by a recessed area of the rose.

* * * * *